US008206148B2

(12) United States Patent
Paesani

(10) Patent No.: US 8,206,148 B2
(45) Date of Patent: Jun. 26, 2012

(54) GAS BURNER FOR COOKING APPLIANCES

(75) Inventor: Carlo Paesani, Camerano (IT)

(73) Assignee: Defendi Italy S.R.L., Camerano (IT)

( * ) Notice: Subject to any disclaimer, the term of this patent is extended or adjusted under 35 U.S.C. 154(b) by 0 days.

(21) Appl. No.: 11/795,751

(22) PCT Filed: Jan. 18, 2006

(86) PCT No.: PCT/EP2006/000401

§ 371 (c)(1),
(2), (4) Date: Jul. 20, 2007

(87) PCT Pub. No.: WO2006/077086

PCT Pub. Date: Jul. 27, 2006

(65) Prior Publication Data

US 2008/0202494 A1 Aug. 28, 2008

(30) Foreign Application Priority Data

Jan. 20, 2005 (IT) ..... VE2005A0004

(51) Int. Cl.
*F23Q 9/00* (2006.01)

(52) U.S. Cl. ..... 431/284; 431/129; 431/354; 431/350; 431/266; 126/39 R; 126/39 E; 126/39 N; 126/39 K; 239/558; 239/559

(58) Field of Classification Search ..... 431/129, 431/354, 284, 350, 351, 266; 126/39 R, 126/39 E, 39 N, 39 K, 39 H; 239/558, 559
See application file for complete search history.

(56) References Cited

U.S. PATENT DOCUMENTS

| | | | | |
|---|---|---|---|---|
| 2,099,205 | A | 11/1937 | Harper | |
| 2,386,113 | A | 10/1945 | Harper et al. | |
| 2,805,710 | A * | 9/1957 | Brumbaugh | 239/544 |
| 2,847,988 | A * | 8/1958 | Hess | 126/39 H |
| 4,518,346 | A * | 5/1985 | Pistien | 431/266 |
| 4,604,049 | A * | 8/1986 | Katchka et al. | 431/80 |
| 4,653,463 | A * | 3/1987 | Gostelow | 126/39 H |
| 5,842,849 | A | 12/1998 | Huang et al. | |
| 6,131,561 | A * | 10/2000 | Maxwell et al. | 126/39 R |
| 6,132,205 | A * | 10/2000 | Harneit | 431/354 |
| 6,263,868 | B1 * | 7/2001 | Koch et al. | 126/39 R |
| 6,325,619 | B2 * | 12/2001 | Dane | 431/284 |

(Continued)

FOREIGN PATENT DOCUMENTS

DE 39 18 722 A1 11/1990

(Continued)

*Primary Examiner* — Steven B McAllister
*Assistant Examiner* — Avinash Savani
(74) *Attorney, Agent, or Firm* — Stein McEwen, LLP

(57) ABSTRACT

For cooking appliances, a gas burner presenting externally at least one annular portion (50), characterized by presenting two gas inlets (3, 10), with which at least two injectors (4, 11) are associated respectively; the first gas inlet (3) supplying the air/gas mixture to a first annular chamber (55) provided in said annular portion (50) and communicating with a series of main ports (24) through which said mixture leaves to form at least one main flame ring (43) in the outer circumference of the annular portion (50); the second gas inlet (10) supplying the air/gas mixture to a second annular chamber (55) provided in said annular portion (50) and feeding a flame ring (27) which constitutes the only flame ignited in the burner when this is operating at minimum power.

9 Claims, 6 Drawing Sheets

U.S. PATENT DOCUMENTS

Figure 1:
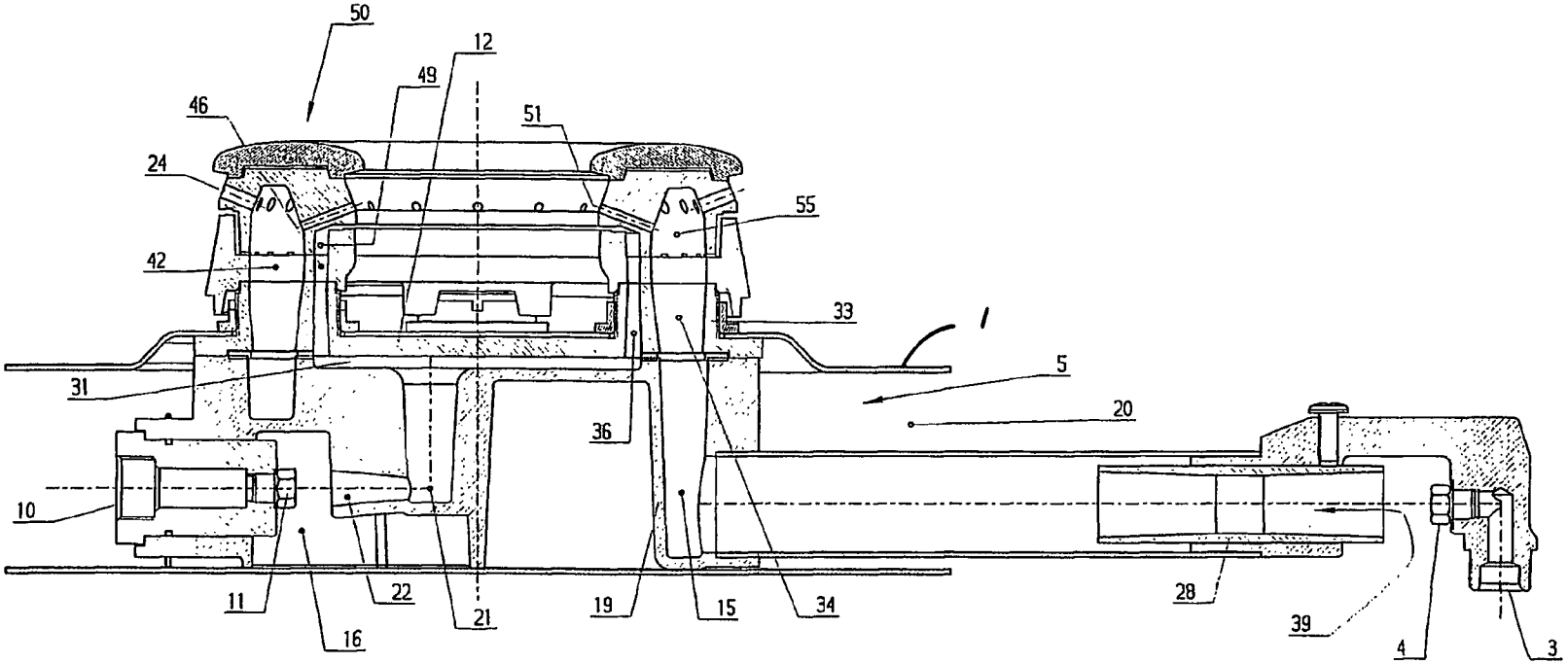

| | | | | |
|---|---|---|---|---|
| 6,537,065 | B1 * | 3/2003 | Shirali et al. | 431/354 |
| 6,780,008 | B2 * | 8/2004 | Koch et al. | 431/354 |
| 7,291,009 | B2 * | 11/2007 | Kamal et al. | 431/284 |
| 2004/0029063 | A1 * | 2/2004 | Bettinzoli | 431/354 |

FOREIGN PATENT DOCUMENTS

| | | |
|---|---|---|
| WO | WO 99/08046 | 2/1999 |
| WO | WO 00/49338 | 8/2000 |
| WO | WO 02/08670 | 1/2002 |

* cited by examiner

GAS BURNER FOR COOKING APPLIANCES

The present invention relates to a gas burner for cooking appliances.

In the high performance burner field there is a continuous search for high power, enabling fast high efficiency cooking to be achieved, while at the same time offering a very low minimum level for cooking those foods requiring low temperature.

These characteristics are much requested and emphasized in certain markets, where they are also combined with the requirement of special constructional characteristics, such as sealing of the cooker worktop to prevent spilled liquids entering the interior of the burner or appliance.

Commercial burners already exist for satisfying these requirements. Dual burners are designed for such requirements, in which at least two flame rings are provided, one positioned within the other.

U.S. Pat. No. 6,132,205, in the name of Harneit, describes a burner with several flame rings in which the outer flame ring is the main ring whereas, to operate under minimum burner capacity, a first inner flame ring and a second flame ring provided in a small central burner are fed.

This configuration presents the drawback that the minimum capacity can never be as low as desired because the gas quantity must be sufficient to ensure that both inner flame rings operate in order to satisfy the tests required according to regulatory standards.

Moreover for mixing with the gas, the burner uses primary air withdrawn from the appliance interior, so that it is influenced by the so-called streaming effect, i.e. by the vacuum created below the region in which the burners are housed, caused by the opening or closure of a door of a kitchen unit or of an underlying oven and which, in burners operating with primary air withdrawn from the appliance interior, extinguishes burners when under minimum conditions.

This imitation compels the cooker manufacturer to house the burners in a completely closed and isolated compartment, which limits heat dispersal and involves greater costs, while not always solving the problem.

EP 1 042 634 B1, in the name of the same applicant, describes a burner fed via a two-way control valve, and consists of two concentric burners of which one, the central burner, is of very small diameter.

The burner described in this patent is conformed such that the central burner uses primary air withdrawn from the external upper part of the appliance.

When in one position the valve feeds both concentric burners, developing maximum power, whereas when in the other position it feeds only the central burner; thus if the valve is further rotated into its minimum capacity position, the flame is present only in the small central burner.

This dual burner, which for the central burner withdraws primary air from the external upper part of the appliance, hence presents the advantage of not being influenced by the aforedescribed streaming effect.

In this burner the minimum capacity is achieved when the gas emerges from and burns on only the inner burner: this enables a very low minimum power to be achieved, as the diameter of the inner burner is sufficiently small. On the other hand the flame concentrates its heat on a relatively small diameter of the pan, which is not perfect for maintaining the temperature low and uniform, this being essential for cooking certain particular foods.

Other technical solutions also exist in which the burners present two flame rings superposed on each other and more or less of the same diameter.

U.S. Pat. No. 6,263,8668 B1 in the name of AGT, and likewise WO 02/108670 in the name of Wolf Appliances, describe a double-bodied burner controlled by a two-way feed valve.

In this type the burner is round and is formed such that its interior comprises two separate chambers which are each fed by its own injector, one chamber being connected to the main flame ring positioned upperly, the other to the stabilization pilot flame ring positioned below the other and substantially of the same or slightly smaller diameter.

The control valve selectively feeds either both flame rings or only the lower stabilization flame ring: in this manner the minimum capacity is achieved about a sufficiently large diameter to achieve under such conditions a more uniform cooking than the aforedescribed traditional dual burners.

However this type of burner also presents drawbacks.

A first drawback consists of the fact that the primary air used for mixing the gas of the two injectors separately feeding the two main and stabilization flames originates from the cooker interior, so that when the burner operates at minimum capacity, it is influenced by the streaming effect.

Another drawback consists of the fact that the diameter of that burner comprising the main slits which create the main flame ring when the burner operates under maximum capacity conditions is substantially equal to the diameter on which the secondary slits are provided and which create the stabilization flame ring constituting the burner minimum operating conditions.

A known relationship exists between the diameter of a burner and its maximum and minimum power. In this respect, for a high power burner the diameter must be fairly large: it follows that the flame diameter at minimum power is also large so that the minimum power cannot be as low as desired. In contrast, by using a small diameter a very low minimum power can be obtained but the maximum power cannot be high.

Hence this is contrary to the requirement of high maximum power with low minimum power.

Another technical solution is described in WO 00/49338 in the name of EGA, which relates to a traditional round burner with one flame ring, in which the outer edge houses another small burner intended to operate under minimum conditions.

The burner is controlled by a two-way valve which selectively feeds either the entire burner or only the small minimum power burner.

This burner presents the drawback that the primary air for mixing with the gas originates from below the burner and is hence influenced by the streaming effect; moreover although the minimum power burner is of very small diameter with resultant very low minimum power, this is concentrated about too small a diameter to obtain ideal pan heating.

An object of the invention is therefore to provide a high power burner which presents optimal heat distribution below the pan, while also presenting a very low minimum power for low temperature cooking.

This and other objects which will be apparent from the ensuing description are attached in an efficient manner according to the invention.

Figure 2:
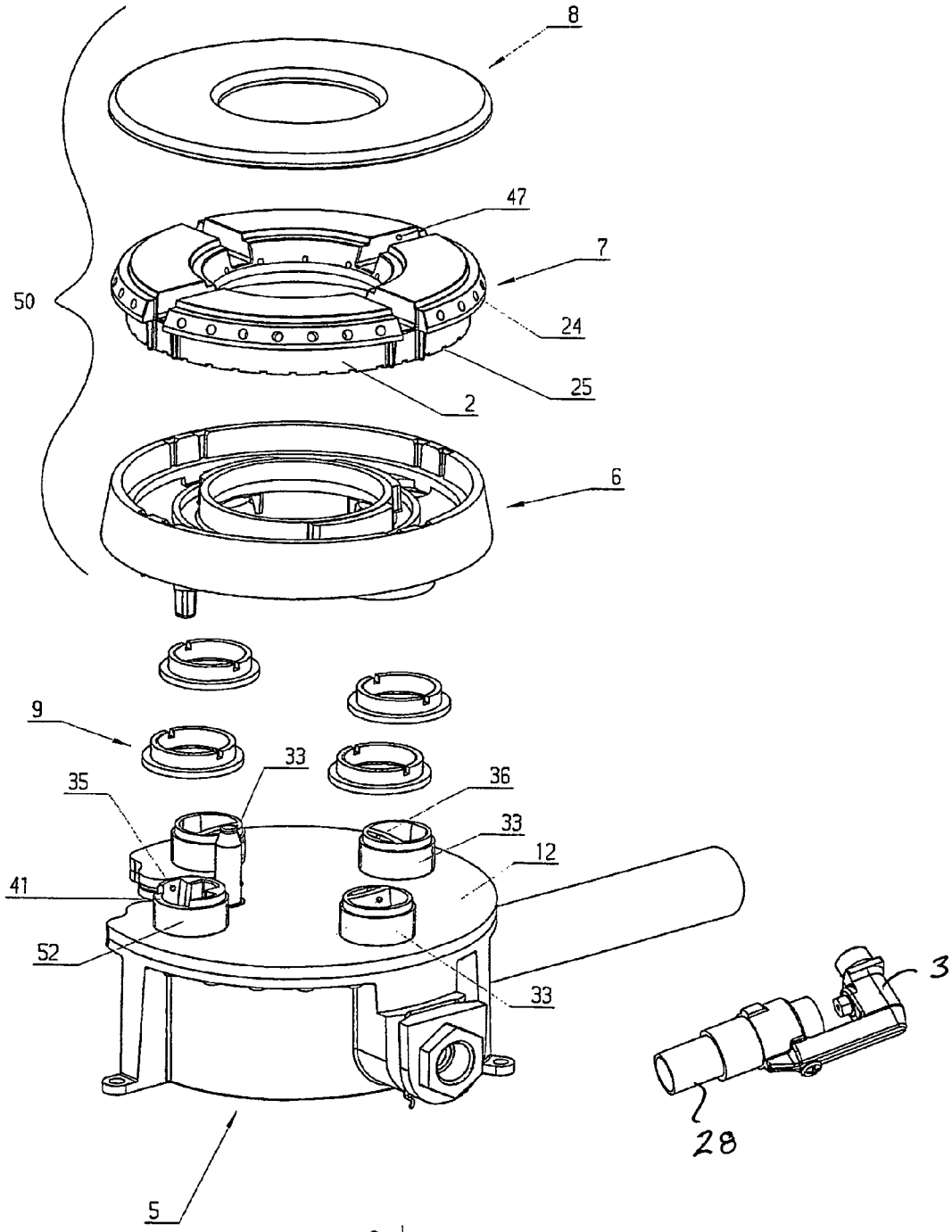
Figure 3:
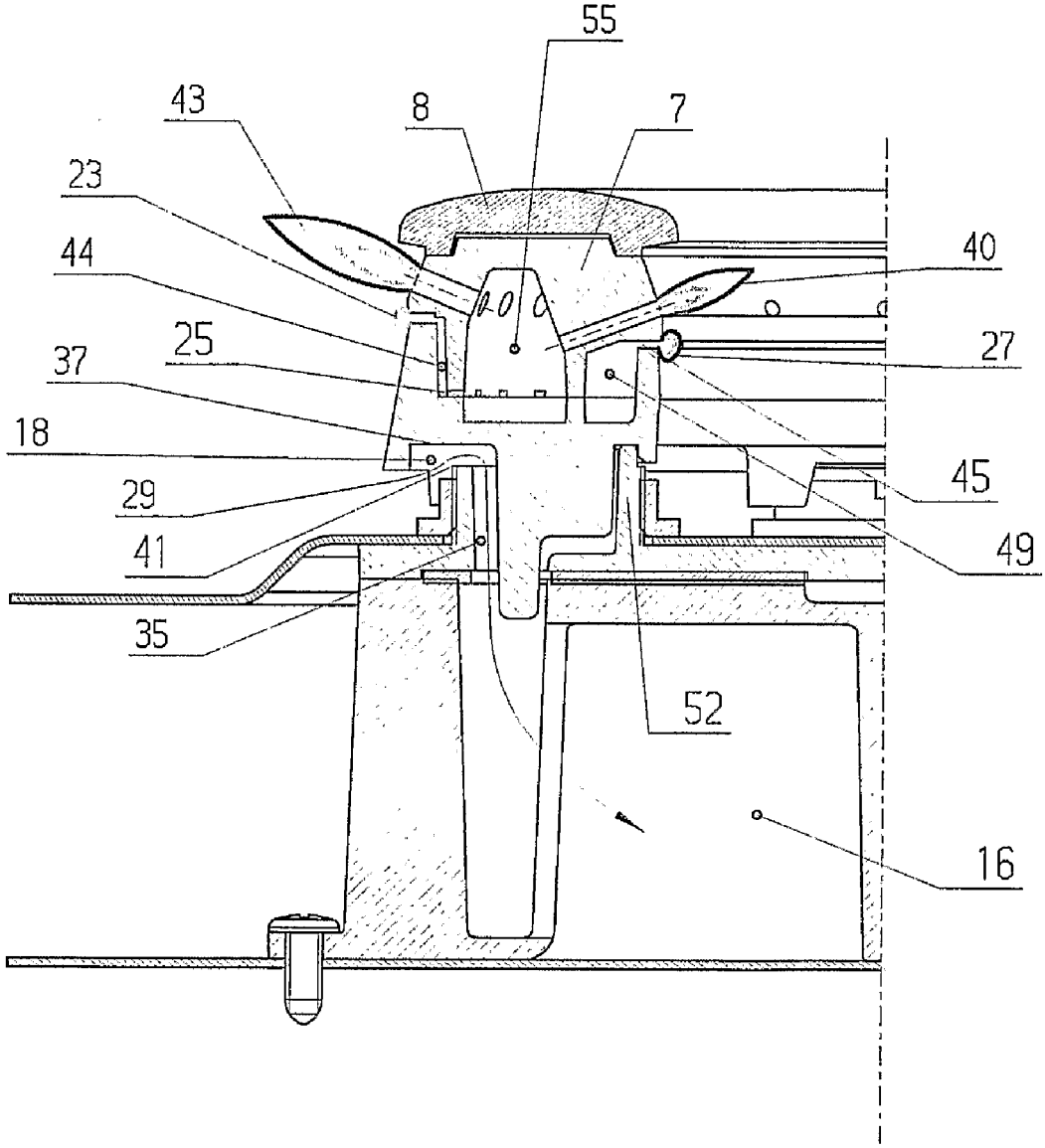
Figure 4:
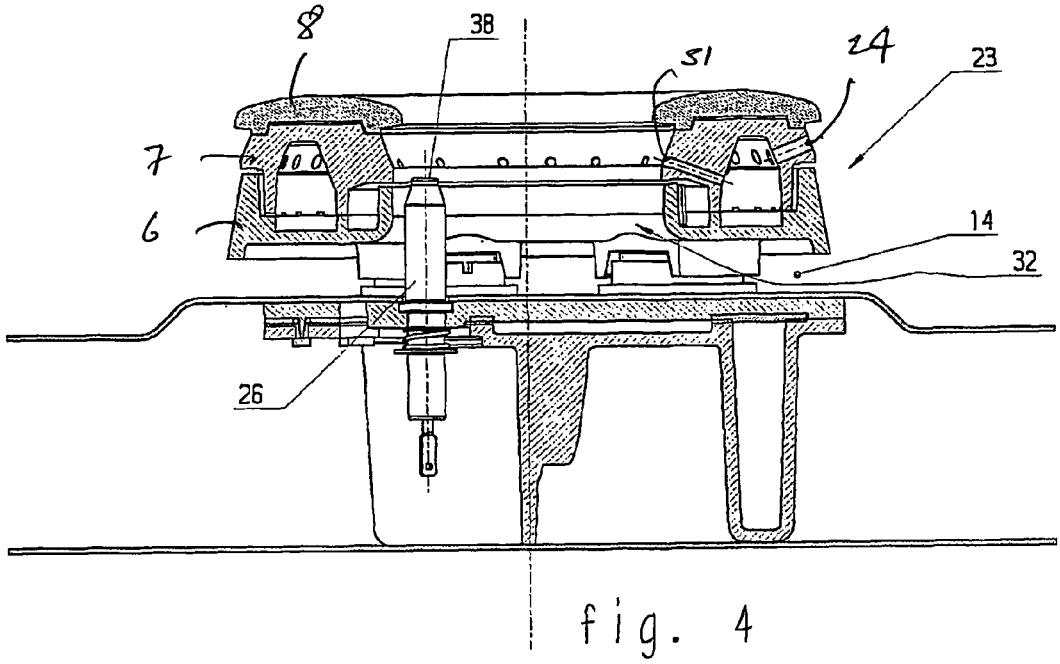
Figure 7:
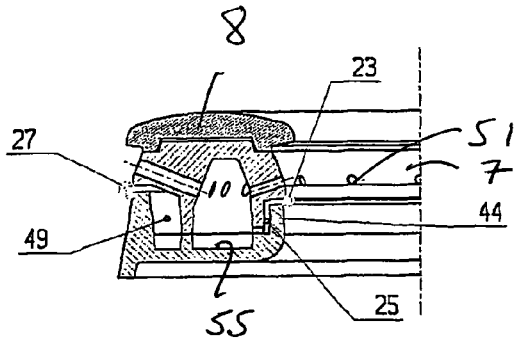
Figure 5:
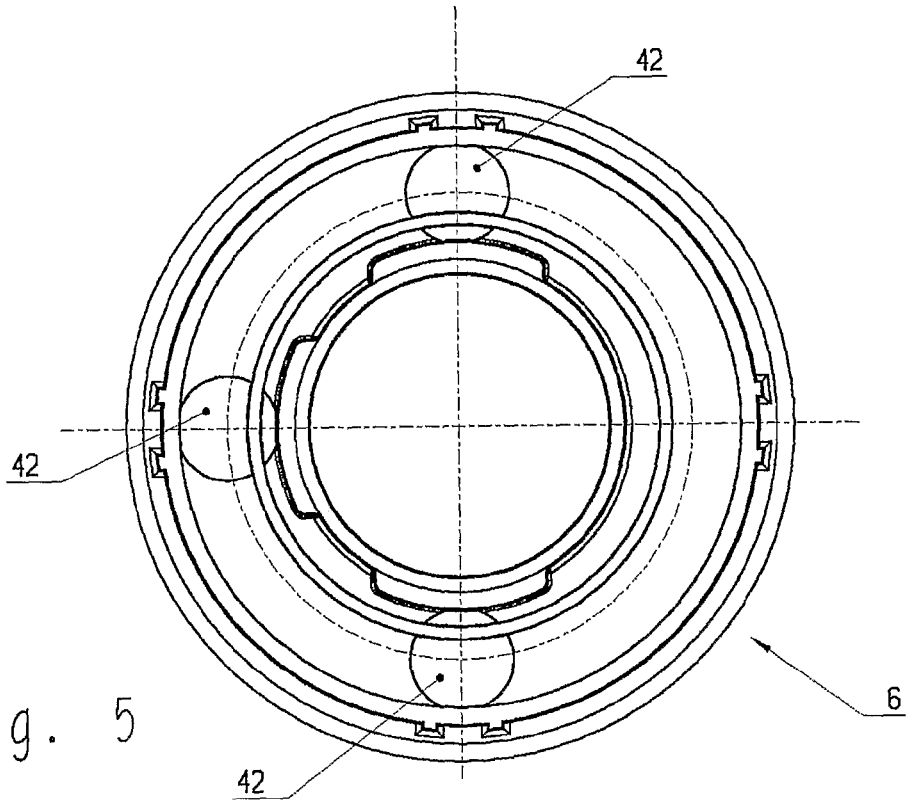
Figure 6:
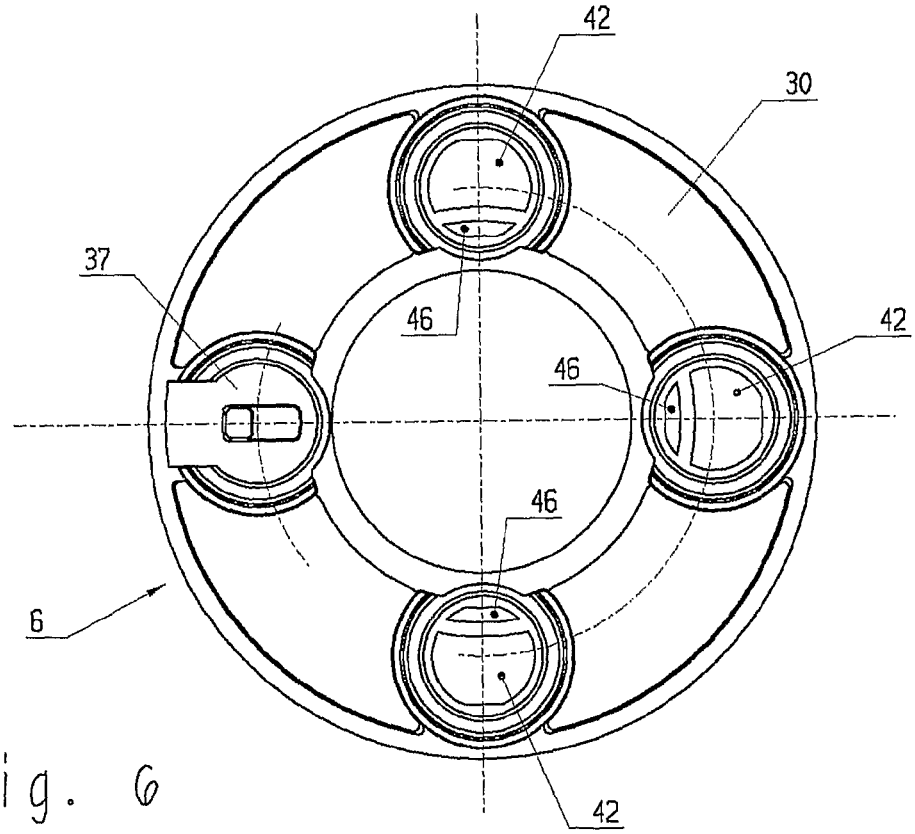
Figure 8:
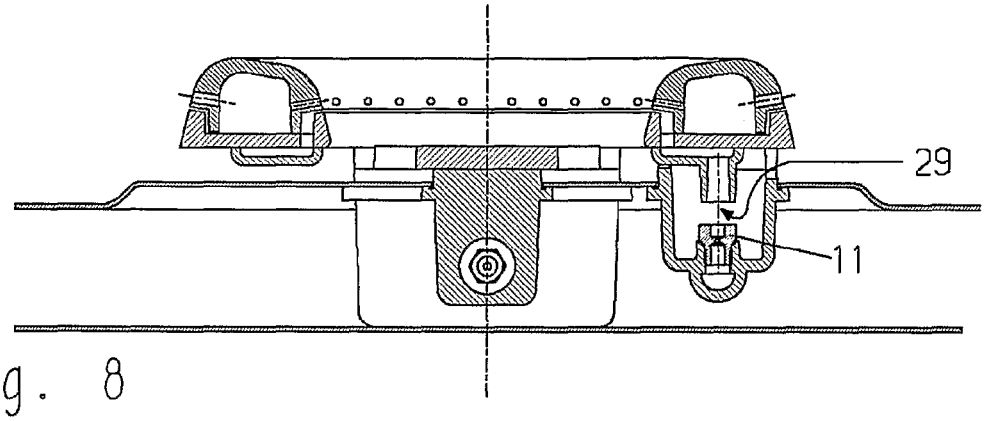
Figure 9:
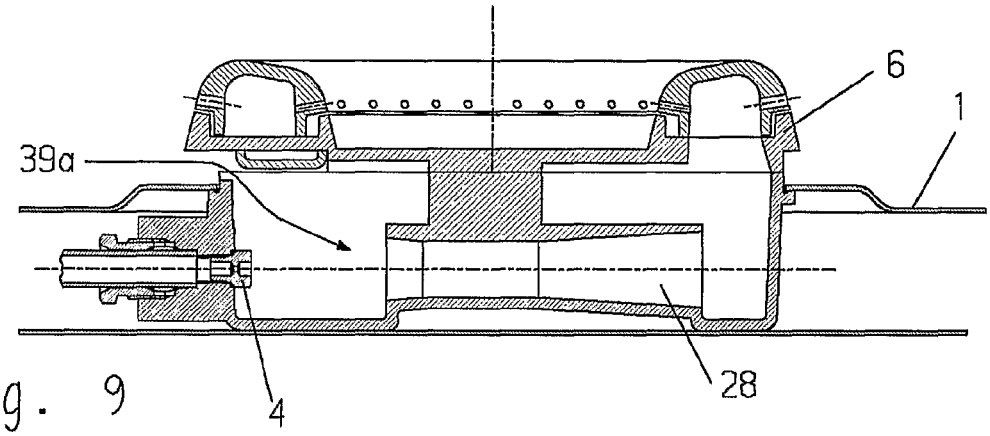
Figure 10:
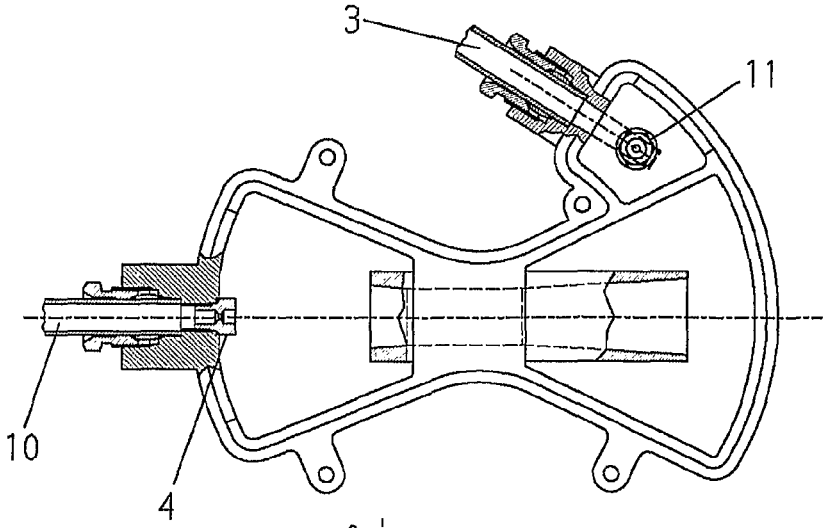

A preferred embodiment of the present invention and some executive variants thereof are further described hereinafter with reference to the accompanying drawings, in which:

FIG. 1 is a longitudinal section through a burner according to the invention, FIG. 2 is an exploded perspective view thereof, FIG. 3 is a section thereof taken through the depression 41, FIG. 4 is a section thereof taken through the passageways 14, FIGS. 5 and 6 are plan views of the base 6 taken from below and from above, FIG. 7 is a sectional view of a variant taken through the chambers 49 and 25, FIGS. 8, 9, 10 are views of a further variant shown in the configuration of primary air from above.

As can be seen from the figures, the burner of the invention comprises substantially a body 5 housed below the metal sheeting 1 of the cooking appliance, and a base 6, a flame divider 7, and a cap 8 positioned above the metal sheeting 1.

Three conduits 33 and a conduit 52 extend from the body 5, to be engaged by fixing nuts 9 which fix the metal sheeting 1 to the body 5.

The body 5 presents a first gas inlet 3 provided with an injector 4 facing a venturi tube 28, the end of which leads to a body 19. A second gas inlet 10 feeds a second injector 11 housed in a chamber 16.

The body 19 presents a frusto-conical conduit 22 facing the injector 11 and leading it to a second vertical conduit 21.

The body 5 presents an ignition plug 26 provided in its upper end with a steel disc 38.

The body 19 is closed at its upper end by an element 12 which defines a C-shaped chamber 15 and a discoid chamber 31.

Three conduits 33 project vertically from the element 12 and are provided with apertures 36 communicating with the discord chamber 31 and apertures 34 communicating with the C-shaped chamber 15.

The conduit 52 presents on its outer edge a depression 41 and an aperture 35 communicating with the chamber 15. On the conduits 33 and 52 rests the base 6, which presents three apertures 42 facing the apertures 34 of the conduits 33 and three apertures 46 facing the apertures 36 of the same conduits.

On its lower surface 30 the base 6 presents a plane 37 lying above the conduit 52 and hence above the apertures 35 to define, with the depression 41, a passage channel 18, as shown in FIG. 3.

The base 6 also forms passageways 14 between its lower surface 30 and the metal sheeting 1.

The flame divider 7 presents on its upper outer edge a first series of main ports 24 and on its upper inner edge a second series of main ports 51.

The lower outer edge 2 of the flame divider 7 comprises apertures 25 disposed radially along its entire circumference.

The flame divider 7 also upperly presents four grooves 47 closed upperly by the cap 8, which rests on the flame divider.

The flame divider 7 defines with the base 6 three annular chambers 44, 55 and 49 respectively.

The chamber 44 is formed by the outer edge of the base 6 and by the outer edge of the flame divider 7 and communicates with a chamber 55 via the apertures 25.

The chamber 55 also communicates with the C-shaped chamber 15 via the apertures 34 of conduits 33.

The chamber 49 is formed by the inner edge of the base 6 and by the inner edge of the flame divider 7 and communicates with the chamber 31 via the apertures 36. The inner edge of the flame divider 7 and the inner edge of the base 6 also form a slit 45 communicating with the annular chamber 49.

The conformation of the burner is such that the disc 38 of the ignition plug 26 faces the slit 45.

The burner of the invention is controlled by a two-way valve (not shown in the drawings), of which one way, the main path, is connected to the gas inlet 3 and the other way, the minimum capacity path, is connected to the gas inlet 10.

The burner of the invention operates in the following manner: by rotating the valve through about 90° from the closed position to the maximum capacity open position, the gas reaches the two inlets 3 and 10 simultaneously.

In this configuration the gas entering through the inlet 3 leaves from the injector 4 to entrain primary air from below the cooking hob, which mixes with it along the venturi 28.

Said air/gas mixture, also known as the main mixture, enters the C-shaped chamber 15, from which via the apertures 34 and 42 it enters the chamber 55. From the chamber 55 the mixture is distributed externally through the outer main slits 24 to create the outer flame ring 43, and through the inner main slits 51 to create the inner flame ring 40. The mixture also passes through the radial apertures 25 to create a flame ring 23 for stabilizing the outer flame ring 43.

At the same time the gas which enters through the inlet 10 reaches the injector 11 and leaves therefrom entraining primary air 29 through the channel 18 from the top of the cooking hob, as shown in FIG. 2.

The gas and primary air 29 enter the frusto-conical conduit 22 to form an air/gas mixture, also known as the simmering mixture. Such mixture is distributed through the conduit 21 to the chamber 31 from which, via the apertures 36 and 46, it reaches the annular chamber 49 where its velocity is reduced to leave through the slit 45, and create the minimum (or simmering) flame ring 27 which stabilizes the inner flame ring 40.

It should be noted that the secondary air 32 required for the flame ring 40 and for the flame ring 27 reaches the interior through the passageways 14.

As the valve operating knob is rotated, the gas throughput decreases, however the operating conditions do not change until the low power configuration is reached in which the flames 43, 40 and 27 are all present in their minimum condition.

On further rotating the knob the limiting configuration is reached in which the valve no longer feeds gas to the inlet 3 but only to the inlet 10: in this configuration all the flames are extinguished with the exception of the flame ring 27 present on the slit 45. To set the burner at a higher power condition, the knob is rotated rearwards so that gas again reaches the inlet 3 and hence the ports 51 and 24.

From the aforegoing it is apparent that the burner of the invention presents numerous advantages and in particular:

- by virtue of the double ring flame divider, a very high power is achieved for a small diameter: in this configuration about 20% of the air/gas mixture is fed to the inner ring,
- for equal power, it achieves a shorter length of the outer flames so that they do not extend beyond the perimeter of the pan while at the same time, by virtue of the inner second ring, the heat distribution to the pan is improved with better cooking,
- the minimum power is very low, distributed along a fairly large circumference so that heat is transferred uniformly to the pan,
- it is substantially insensitive to disturbances deriving from air movements within the appliance which when in its critical minimum condition could lead to extinguishing of the burner.

In the embodiment shown in FIG. 7 the chambers 44 and 49 are disposed inverted. This embodiment presents a larger minimum flame ring 27, enabling heat to be distributed to the pan along a larger diameter.

In the embodiment shown in FIG. 8 the injectors 4 and 11 are positioned within the perimeter of the base 6 and hence accessible from above for easy replacement without having to remove the metal sheeting from the appliance.

This embodiment presents the characteristic of using primary air originating from the outside both for the injector 11 and for the injector 4.

In another embodiment in addition to the annular portion 50, there is a central portion present, internal and concentric thereto, in which another flame ring is present; when under minimum operating conditions the only flame ignited is again the flame ring 27.

The invention claimed is:

1. A gas burner comprising:

a) an annular body with a first gas inlet and a second gas inlet adapted to receive gas which entrains air within said body to form an air/gas mixture, b) an ignition plug extending upwardly from said body, c) an upwardly opening base seated on said body, the upwardly opening base having a central annular base wall forming an inner annular base channel and a concentric outer annular base channel, d) a flame divider including an annular flange that extends into said base, e) said flange having a circumferential outer wall and a circumferential inner wall, f) first and second annular chambers defined between said flame divider and said base, the first annular chamber formed between the central annular base wall and communicating with the outer annular base channel and the second annular chamber formed between the central annular base wall and communcating with the inner annular base channel, g) a first series of outwardly directed main ports defined at the upper edge of said outer wall of said flame divider, h) a second series of inwardly directed main ports defined at the upper edge of said inner wall of said flame divider, i) one of said annular chambers supplying the air/gas mixture to said main ports in said flame divider to create an outwardly directed main flame ring and an inwardly directed main flame ring, and j) radial apertures defined in the lower edge of said flame divider to allow flow of the air/gas mixture from said first annular chamber to said second annular chamber to form a minimum power flame ring on the exterior of said gas burner to stabilize said inwardly directed main flame ring.

2. The gas burner as defined in claim 1, further including a first injector associated with said first inlet in said body and a second injector associated with said second inlet in said body to receive gas which entrains air and forms an air/gas mixture, a third annular chamber defined between said flame divider and said base, said second inlet communicating with said third annular chamber, said third annular chamber discharging the air/gas mixture through a slit defined between said flame divider and said base to form a simmering flame.

3. The gas burner as defined in claim 2, wherein said simmering flame stabilizes said inwardly directed main flame ring when said first and second inlets receive the air/gas mixture.

4. The gas burner as defined in claim 2, wherein said simmering flame provides low cooking heat when only said second inlet receives gas.

5. The gas burner as defined in claim 1, wherein fixing nuts are employed to secure metal sheeting to said body.

6. A gas burner comprising:

a) a body having a first gas inlet and a second gas inlet, the first inlet having a first injector fed with gas and the second inlet having a second injection, said first injection entraining primary air within said body to form a first air/gas mixture, said second injector entraining air within said body to form a second air/gas mixture, which entrains primary air within said body to form a first air/gas mixture and respectively a second air/gas mixture, b) an upwardly opening base seated on said body, the upwardly opening base having a central annular base wall forming an inner annular base channel and a concentric outer annular base channel, c) an annular flame divider seated on said base and having a circumferential outer wall and a circumferential inner wall, d) a first outer annular chamber defined between said annular flame divider and said base, the first annular chamber formed between the central annular base wall and communicating with the outer annular base channel, e) said first annular chamber fed with said first air/gas mixture, f) a second inner annular chamber defined between said annular flame divider and said base, the second annular chamber formed between the central annular base wall and the inner annular base channel, g) said second annular chamber fed with said second air/gas mixture, h) said first and said second annular chambers being concentric to the another, i) a first series of main ports defined on the outer wall of said annular flame divider and directed outwardly, and a second series of main ports defined on the inner wall of said annular flame divider and directed inwardly, said first and second series of main portions being fed with said air/gas mixture flowing from said outer annular chamber, j) an annular slit, obtained on the inner wall of said annular flame divider and forming a minimum power flame ring directed inwardly and fed with said second air/gas mixture coming from said inner annular chamber, said minimum power flame ring being the only flame ignited in the gas burner when said gas burner is operating at minimum power.

7. A burner as claimed in claim 6, wherein all of the primary air required for burner operation originates from the exterior of the gas burner for feeding the first and second injectors.

8. A burner as claimed in claim 6, wherein the minimum power flame ring constitutes the stabilization flame for the flame ring generated by said second series of main ports.

9. A burner as claimed in claim 6, wherein a flame divider presents at least one radial channel.

* * * * *